US009776394B2

(12) United States Patent
Anderson et al.

(10) Patent No.: US 9,776,394 B2
(45) Date of Patent: Oct. 3, 2017

(54) NOZZLE CONDITION EVALUATION

(71) Applicant: HEWLETT-PACKARD DEVELOPMENT COMPANY, L.P., Houston, TX (US)

(72) Inventors: Daryl E. Anderson, Corvallis, OR (US); Eric T. Martin, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/306,028

(22) PCT Filed: Apr. 25, 2014

(86) PCT No.: PCT/US2014/035418

§ 371 (c)(1),
(2) Date: Oct. 21, 2016

(87) PCT Pub. No.: WO2015/163906

PCT Pub. Date: Oct. 29, 2015

(65) Prior Publication Data

US 2017/0043573 A1 Feb. 16, 2017

(51) Int. Cl.

| | |
|---|---|
| ***B41J 2/045*** | (2006.01) |
| ***B41J 2/30*** | (2006.01) |
| ***B41J 29/38*** | (2006.01) |
| ***B41J 2/21*** | (2006.01) |

(52) U.S. Cl.

CPC ..... *B41J 2/0451* (2013.01); *B41J 2/0458* (2013.01); *B41J 2/04555* (2013.01); *B41J 2/2142* (2013.01); *B41J 29/38* (2013.01)

(58) Field of Classification Search

CPC .... B41J 2/0451; B41J 2/04555; B41J 2/0458; B41J 2/2142; B41J 29/38

USPC ..... 347/14

See application file for complete search history.

(56) References Cited

U.S. PATENT DOCUMENTS

| | | | |
|---|---|---|---|
| 2005/0007410 | A1 | 1/2005 | Murayama et al. |
| 2006/0098251 | A1 | 5/2006 | Eklund et al. |
| 2006/0139392 | A1 | 6/2006 | Fernandez et al. |
| 2006/0284925 | A1 | 12/2006 | Komplin et al. |
| 2009/0058920 | A1 | 3/2009 | Endo et al. |
| 2010/0026753 | A1 | 2/2010 | Kuroda et al. |
| 2011/0148967 | A1 | 6/2011 | Schippers |

FOREIGN PATENT DOCUMENTS

| | | | |
|---|---|---|---|
| JP | 2012111214 | A | 6/2012 |
| KR | 20140005874 | A | 1/2014 |

OTHER PUBLICATIONS

Structure- and Fluid-Dynamics in Piezo Inkjet Printheads; Herman Wijshoff, OceTechnologies B.V., Venlo; Dec. 20, 2007; pp. 1-185.

*Primary Examiner* — Huan Tran
*Assistant Examiner* — Alexander D Shenderov
(74) *Attorney, Agent, or Firm* — HP Inc.-Patent Department

(57) ABSTRACT

The present subject matter relates to evaluating nozzle condition of a plurality of nozzles. In one example, drive bubble detect (DBD) test results for a set of nozzles from among the plurality of nozzles are stored by a print head in a test result register, where the test result register is provided onto the print head. Further, status bits of a result-ready register provided in the print head are set to a predetermined value by the print head responsive to storing of the DBD test results in the test result register. Further, based on the setting, the DBD test results are obtained by a control unit, from the test result register, for evaluating the nozzle condition.

15 Claims, 6 Drawing Sheets

NOZZLE CONDITION EVALUATION

BACKGROUND

Inkjet printing involves releasing ink droplets onto a print medium, such as paper. The ink droplets bond with the paper to produce visual representations of texts, images or any other graphical content, onto the paper. In order to accurately produce the details of the printed content, nozzles in a print head accurately and selectively release multiple ink drops. Based on movement of the print head relative to the printing medium, the entire content is printed through the release of such multiple ink drops. Over a period of time and use, the nozzles of the print head may develop defects and hence would not operate in a desired manner, thereby affecting the print quality. In such a case, working condition of the print nozzles may have to be monitored so as to take a corrective action.

BRIEF DESCRIPTION OF DRAWINGS

The detailed description is described with reference to the accompanying figures. In the figures, the left-most digit(s) of a reference number identifies the figure in which the reference number first appears. The same numbers are used throughout the figures to refer like features and components.

DETAILED DESCRIPTION

Figure 1A:
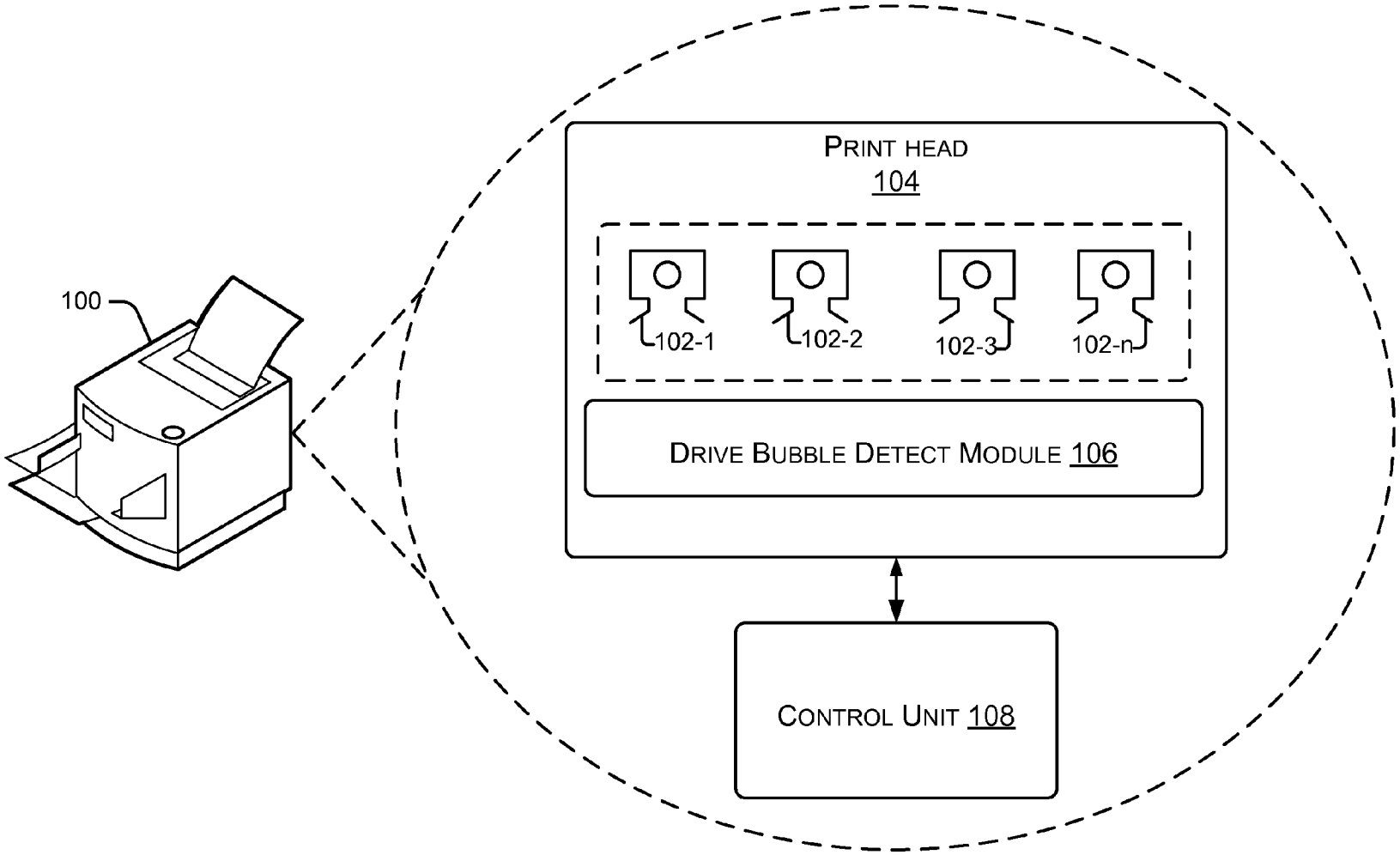
FIG. 1*a* illustrates a printer incorporating a system for evaluating nozzle condition of a plurality of nozzles, according to an example of the present subject matter.

The present subject matter relates to evaluating nozzle conditions for a plurality of nozzles of an inkjet printing system. The inkjet based printing machines or printers are used for printing images or characters on a print medium to obtain printed documents. The printers print images by expelling ink drops over the print medium in accordance with a pattern of the image or the characters that are to be printed.

The printers include a print head for generating ink drops and an orifice layer having a plurality of nozzles for expelling a small volume of ink on the print medium upon which printing or marks are to be placed. Generally, the nozzles are arranged into a plurality of nozzle columns or arrays on the print head, with each nozzle column having a set of nozzles. The nozzles are arranged into the columns such that properly sequenced ejection of ink from the nozzles causes characters or other images to be printed upon the print medium as the print head and the print medium are moved relative to each other.

Further, the orifice layer is attached to an ink barrier layer defining ink channels for connecting each nozzle to a corresponding ink chamber storing the ink. Further, each ink chamber is associated with corresponding thermal resistors which are individually addressed with a current pulse to momentarily vaporize the ink to form a bubble. The bubble, also referred to as a drive bubble, may further expand driving, or ejecting, an ink drop onto the print medium. As an ink drop is released, the bubble collapses. By energizing thermal resistors in different combinations as the print head moves across the paper, the printer prints different characters on the paper. Further, for example, the print head may move laterally with the print medium being conveyed through a conveying mechanism.

It should be noted that the nozzle is subjected to such cycles of heating, drive bubble formations, drive bubble collapses, and then replenishments of the ink supply. Over a period of time, and depending on other operating conditions, the nozzle within the print head may get blocked. Since the ink drop has to form and be released at precise instances of time, any such blockages in the nozzle are likely to have an impact on the print quality. Accordingly, in order to ensure that print quality is maintained, the condition of the nozzle, i.e., whether it is blocked or whether it is experiencing other issues, such as a deprimed chamber is determined. Further, failure of circuit coupled to the thermal resistor may prevent heating of the ink chamber, which will also prevent proper ink drop ejection.

In cases where such a situation is detected, appropriate measures, such as servicing or nozzle replacements may be performed much in advance without affecting the print quality of the printer under consideration. The condition of the nozzle is monitored and determined through a detection circuitry. Such detection circuitry involves associating a sensor with the nozzle. The sensor may be used for detecting presence or absence of the drive bubble. For example, any ink in contact with the sensor will offer less electrical impedance to the current provided through the sensor. Similarly, at the time when the drive bubble is present, air within the drive bubble will offer high impedance as compared to the impedance offered by the ink volume.

Depending on the measurements of impedance, and the corresponding voltage or current variations due to the presence (or absence) of ink within the ink chamber, it may be determined whether the drive bubble has formed or not. In this manner, an indication whether the nozzle is operating in the desired manner, may be obtained. Such a determination may subsequently be used for evaluating a nozzle condition of the nozzles to determine which nozzles are working fine and which are not.

The obtained indications, or results, may be processed on-chip, i.e., on the print head, but such an implementation may require complex circuitry and might be intensive in terms of both space within the printer head and in terms of cost. The results may also be communicated from the detection circuits to a processing unit of the printer for processing so as to determine the condition of the print nozzle. In such cases, communicating such results off-chip to the processing unit or to other components of the printer may require bandwidth. Furthermore, communicating the results off-chip may introduce timing issues which might affect the accuracy of such determinations.

Inkjet printers, in accordance with an example of the present subject matter, are described. The inkjet printers as described include a print head having a plurality of nozzles and a Drive Bubble Detect (DBD) circuitry for performing DBD tests for the nozzles to determine working conditions of the nozzles. The printer further includes a control unit coupled with the print head and the nozzles, for evaluating a print head condition. In one example, the control unit receives the results of the DBD tests to determine the print head conditions. Based on the determination, the working condition of the nozzles may be estimated. Processing the DBD test results outside the print head using the control unit facilitates in optimizing cost and space utilization in the print head.

In one example, the DBD circuitry may test the plurality of nozzles. For instance, the DBD circuitry may determine impedance associated with each nozzle, due to the formation of the drive bubble, to obtain DBD test results indicating whether the nozzle is in a working condition or not. The print head may further include a test result register and a result-ready register for storage of the DBD test results and indication of such storage, respectively.

Further, for testing, the DBD circuitry may divide the plurality of nozzles into different sets of nozzles such that the DBD tests are performed for one set of nozzles at a time. In one example, a set of nozzle may include all nozzles that are positioned and sequenced to eject ink at the same time. The DBD circuitry may subsequently store the DBD test results for the nozzles in the test result register provided in the print head. The DBD circuitry may further set status bits of the result-ready register provided within the print head in response to storage of the DBD test results in the test result register. For instance, the DBD circuitry may set the status bits to a predetermined value, say, '1' or '0' to indicate storage of the DBD test results in the test result register. Further, in order to avoid overwriting in the test result register, the DBD circuitry may pause the DBD testing for other nozzles until the DBD test results already stored in the test result register are obtained by the control unit.

Once the result-ready register indicates that the DBD test results have been stored, the control unit may access the test result register to obtain the DBD test results. The control unit may subsequently process the DBD test results for evaluating the nozzle condition of the nozzles for which the DBD test results are provided. For instance, the control unit may analyze the DBD test results to determine whether the nozzles are functioning correctly or not and whether any of the nozzles needs to be replaced for maintaining a good print quality. The control unit may further store the DBD test results in a printer memory for being accessed later, for example, by the control unit or other components, such as a processing unit of the printer.

Further, upon obtaining the DBD test results from the test result register, the control unit may reset the status bits of the result-ready register to indicate transfer of the test results from the test result register to the printer memory. The DBD circuitry may subsequently continue performing the DBD testing for the remaining nozzles.

In one example, the DBD circuitry may store the DBD test results for just those nozzles that have failed the DBD test. The DBD circuitry in such a case may thus update the test result register and the result-ready register when any nozzle is determined to have failed the DBD test. The DBD circuitry in such a case may further update a nozzle count register to indicate the nozzle for which the DBD test result has been saved. In another example, the DBD circuitry may store the DBD test results for each set of nozzles irrespective of whether the nozzle has failed or passed the DBD test.

The present subject matter thus facilitates in processing the DBD test results outside the print head. Processing the DBD test results outside the print head, say, in the printer memory facilitates in optimizing cost and space utilization on the print head as no additional memory units and processing units have to be provided in the print head for storing and processing the DBD test results. Further, using the result-ready register to indicate storage of the DBD test results in the test result register facilitates in reducing time that may have been used by the control unit to determine storage of DBD test results. Setting up of the status bits of the result-ready register further facilitates in reducing time utilized by the DBD circuitry to determine transfer of DBD test results from the test result register. Since the DBD test results are instantly copied from the test result register, the DBD circuitry can resume the DBD tests for remaining nozzles in a very short time. Alternately, storing the DBD test results for simply the failed nozzles facilitates in further reducing the time utilized for performing the DBD tests as the DBD circuitry doesn't have to pause after testing each set of nozzles. Further, storing the DBD test results for simply the failed nozzles facilitates in reducing data that has to be transferred and processed by the control unit.

The manner in which the present subject matter is implemented is explained in details with respect to FIGS. 1 to 4. While aspects of the present subject matter can be implemented in any number of different systems, environments, and/or configurations, the examples are described in the context of the following system(s).

FIG. 1*a* illustrates a printer 100 incorporating a system for evaluating nozzle condition of a plurality of nozzles, according to an example of the present subject matter. The printer 100 includes a plurality of nozzles 102-1, 102-2, 102-3, . . . , 102-*n* provided in a print head 104. The plurality of nozzles 102-1, 102-2, 102-3, . . . , 102-*n* are hereinafter collectively referred to as nozzles 102 and individually referred to as nozzle 102. Further, the nozzles 102 may be arranged into a plurality of nozzle columns or arrays on the print head 104, with each nozzle column having a group of nozzles. The nozzles 102 are arranged into the nozzle columns such that properly sequenced ejection of ink from the nozzles causes characters or other images to be printed upon a print medium as the print head 104 and the print medium are moved relative to each other.

The print head 104 further includes a drive bubble detect (DBD) module 106 implementing a DBD circuitry. In one example, the DBD module 106 is communicatively coupled to the nozzles 102. The DBD module 106 performs DBD testing, for each associated nozzle 102, to evaluate the nozzle condition. Although the DBD module 106 is shown as an entity, the DBD module 106 may also be implemented as distributed modules including multiple DBD modules 106. In such a case each DBD module may be coupled to a corresponding nozzle column and its associated nozzles 102.

The printer 100 further includes a control unit 108 coupled to the print head 104 for processing DBD test results, obtained based on the DBD test, to evaluate the nozzle condition. In order to evaluate the nozzle condition, the control unit 108 may initially request the DBD module 106 to perform the DBD test for the nozzles 102. In one example, the DBD module 106 may perform the DBD test such that at given time the DBD tests are performed for a set of nozzles 102 from among the plurality of nozzles simultaneously. In one example, a set of nozzles 102 may include all nozzles 102 that are positioned and sequenced to eject ink at the same time.

Upon receiving a DBD testing command from the control unit 108, the DBD module 106 performs the DBD test for a first set of nozzles 102. For instance, the DBD module 106 may obtain impedance associated with the nozzles 102 at predetermined time instants to obtain DBD test result indicating working condition of each of the set of nozzles 102. The DBD module 106 subsequently stores the DBD test results in a test result register (not shown in the figure) provided in the print head 104. On updating the test result register, the DBD module 106 may pause the DBD testing for other nozzles 102 in order to avoid overwriting in the test result register. The DBD module 106 may pause the DBD testing until the DBD test results for the first set of nozzles 102 are obtained by the control unit 108. The DBD module 106 further set status bits of a result-ready register (not shown in the figure) provided in the print head 104 to indicate storage of the DBD test results in the test result register by the DBD module 106. For instance, the DBD module 106 may set the status bits to a predetermined value, say, '1' or '0' to indicate storage of the DBD test results in the test result register. In one example, the status bit value '1' may indicate storage of result while the status bit value of '0' may indicate an empty test result register and vice versa.

The control unit 108, which is regularly monitoring the result-ready register, may subsequently access the test result register to obtain the DBD test results from the test result register. The control unit 108 may subsequently process the DBD test results for evaluating the nozzle condition of the set of nozzles 102 for which the DBD test results are provided. The control unit 108 may further reset the status bits of the result-ready register to indicate transfer of the test results from the test result register. The DBD module 106 may accordingly continue performing the DBD testing for the remaining nozzles 102.

Figure 1B:
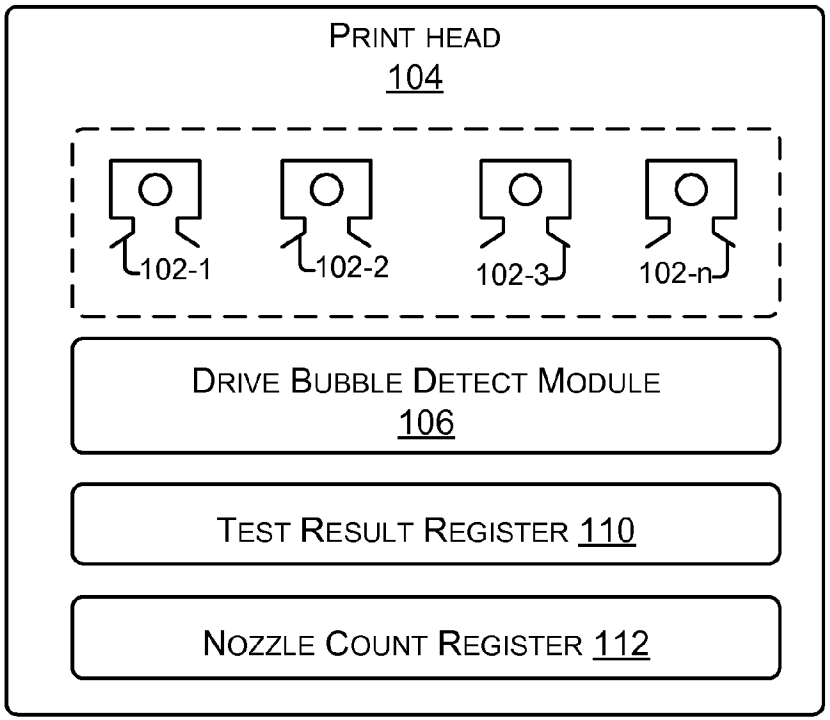
FIG. 1*b* illustrates a print head incorporating another system for evaluating the nozzle condition of a plurality of nozzles, according to an example of the present subject matter.

FIG. 1*b* illustrates the print head 104 incorporating another system for evaluating the nozzle condition of the plurality of nozzles 102, according to an example of the present subject matter. As previously described, the print head 104 includes the DBD module 106 for performing the DBD tests for each of the nozzles 102. The print head 104 further includes a test result register 110 for storing DBD results obtained based on the DBD tests performed by the DBD module 106.

In one example, the DBD module 106 may not update the DBD test results for each set of nozzles and instead register the DBD test results for the nozzles 102 that have failed the DBD test results. The DBD module 106 may thus continue to perform the DBD test for different sets of nozzles 102 without pausing for storing the DBD test results in case no nozzle fails the DBD test. In case the DBD module 106 determines that any nozzle has failed the DBD test, the DBD module 106 may update the test result register 110 and the result-ready register. The DBD module 106 in such a case may pause the DBD testing until the DBD test result for the failed nozzle are obtained by the control unit 108.

The DBD module in such a case may further update a nozzle count register 112 provided in the print head 104 to indicate the nozzle 102 for which the DBD test result has been stored in the test result register 110. Indicating a number of the nozzle 102 facilitates the control unit 108 to identify the nozzle 102 for which the DBD test results have been stored in the test result register 110. Identifying the nozzle 102 becomes useful for the control unit 108 in case the control unit ascertains that the nozzle 102 is faulty and has to be replaced.

Figure 1C:
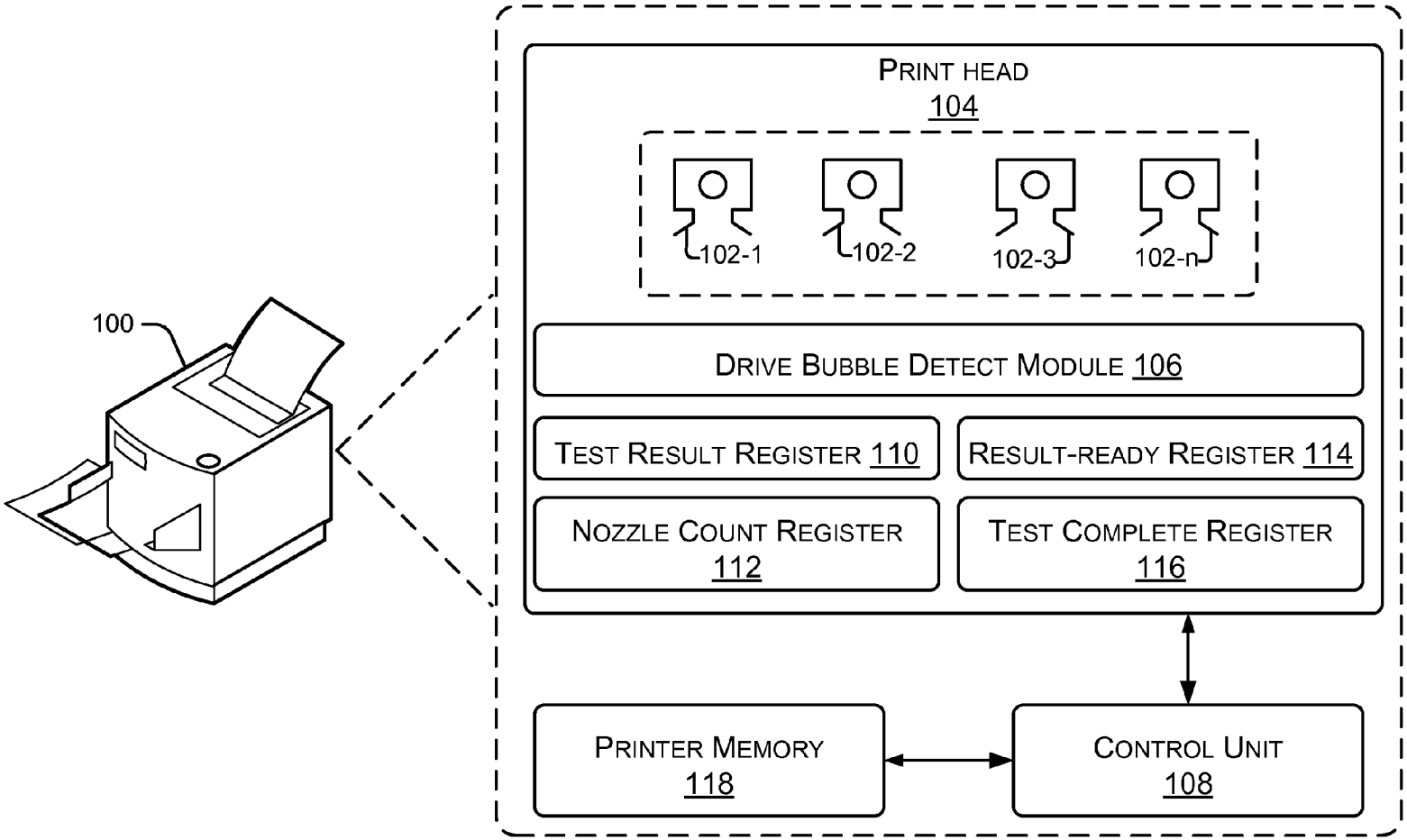
FIG. 1*c* illustrates a block diagram of the printer incorporating the system for evaluating the nozzle condition, according to an example of the present subject matter.

FIG. 1*c* illustrates a block diagram of the printer 100 incorporating the system for evaluating the nozzle condition, according to an example of the present subject matter. As previously described, the printer 100 includes a print head 104 having the plurality of nozzles 102 and the DBD module 106 for performing DBD test for the nozzles to obtain DBD test results for determining nozzle condition of the nozzles 102. The print head 104 further includes a result-ready register 114, the nozzle count register 112, and a test complete register 116. The printer 100 further includes printer memory 118 and the control unit 108 for storing and processing the DBD test results outside the print head 104, respectively.

In operation, to evaluate the nozzle condition, the control unit 108 sends a DBD testing command to the DBD module 106 requesting the DBD module 106 to initiate the DBD testing for the nozzles 102. Upon receiving the DBD testing command, the DBD module 106 may set up the nozzles 102 for DBD testing. In one example, the DBD module 106 may initially reset nozzle data for each nozzle 102 to the value '0'. The nozzle data of '0' may indicate that the nozzle 102 should not eject an ink drop on receiving a subsequent fire pulse, while the nozzle data of '1' may indicate that the nozzle 102 should eject an ink drop on receiving the next fire pulse. The DBD module 106 may further set status of a fire data register (not shown in the figure) to '1' for each nozzle 102 in the set of nozzles that is to be tested first. Setting the status of the fire data register for the nozzle 102 to be tested to '1' selects the nozzle 102 on the print head 104 to activate thermal heating resistors (not shown in the figure) for heating of the ink in the nozzle 102. In another example, the control unit 108 or another component, such as a processing unit (not shown in the figure) of the printer 100 may activate a fire pulse generator (not shown in the figure) for each nozzle 102 of the set of nozzles 102.

The DBD module 106 subsequently resets at least the result-ready register 114 and the test result register 110. In one example, the DBD module 106 may further reset the test complete register 116 and the nozzle count register 112. The DBD module 106 may reset the result-ready register 114, the test result register 110, the test complete register 116, and the nozzle count register 112, for example, by clearing previous bit values and setting bit values for each register to a predetermined bit value, say, '0'.

Once the nozzles 102 and the registers are ready the DBD module 106 may perform the DBD test. As previously described, the DBD module 106 may perform the DBD test such that at given time the DBD tests are performed for the selected set of nozzles 102 from among the plurality of nozzles simultaneously. In one example, once the selected set of nozzles 102 is fired, the DBD module 106 may obtain the DBD test results indicating whether the nozzles have passed or failed the DBD test. For instance, the DBD module 106 may determine whether the nozzles have passed or failed based on, for example, impedances associated with the nozzles 102. In one example, the DBD test results may include, data, such as information about whether the drive bubble were formed at a predetermined time or not and whether the drive bubble collapsed at another predetermined time or not time. In another example, the DBD test results may further include, data, such as the time by when the drive bubble was formed, the time by when the drive bubble collapsed, and strength of the drive bubble (impedance value).

The DBD module 106 may subsequently store the DBD test results in the test result register 110. Upon storing the DBD test results, the DBD module 106 may further pause the DBD testing for other nozzles 102 until the DBD test results already stored in the test result register 110 are obtained by the control unit 108. The DBD module 106 may pause the DBD testing in order to avoid overwriting in the test result register 110. The DBD module 106 may further set status bits of the result-ready register 114 to indicate updating of the test result register 110. As previously described, the DBD module 106 may set the status bits to a predetermined value, say, '1' indicate storage of the DBD test results in the test result register 110.

Subsequently, upon noticing change in the status bit of the result-ready register 114, the control unit 108 may access the test result register 110 to obtain the DBD test results. The control unit 108 may subsequently process the DBD test results for evaluating the nozzle condition of the nozzles 102 for which the DBD test results are provided. For instance, the control unit 108 may analyze the DBD test results to ascertain reasons for the failure of the nozzles 102 that failed the DBD test. The control unit 108 may further analyze the DBD test results to determine whether any of the nozzles 102 has to be replaced for maintaining a good print quality. The control unit 108 may further store the DBD test results in the printer memory 118 for being accessed later, for example, by the control unit 108 or other components, such as the processing unit of the printer 100.

The control unit 108 may further reset the status bits of the result-ready register 114 to the predetermined value, say, '0' to indicate transfer of the test results from the test result register 110 to the printer memory 118. The DBD module 106 may subsequently continue performing the DBD testing for the remaining nozzles 102.

In one example, as previously described, the DBD module 106 may register the DBD test results for those nozzles 102 that have failed the DBD test results and may skip the registering for the nozzles 102 that pass the DBD test. The DBD module 106, in said example, may ascertain if any of the nozzles 102 from the set of nozzles 102 being tested have failed the test. For instance, the DBD module 106 may ascertain whether impedance associated with any of the nozzles 102 is lesser or greater than a predetermined threshold impedance to determine if the nozzle 102 has failed the DBD test.

In case a nozzle 102 is determined to have failed the test, the DBD module 106 may store the DBD test results in the test result register 110 and accordingly update the result-ready register 114. The control unit 108 may subsequently obtain the DBD test results and reset the result-ready register 114 indicating the DBD module 106 to continue with DBD testing of the remaining nozzles 102. Storing the DBD test results of the failed nozzles 102 facilitates in reducing the time for performing the DBD tests for all the nozzles 102 as the DBD module 106 doesn't have to stop for registering the DBD test results for all the sets of nozzles 102.

The DBD module 106, in said example, may further update the nozzle count register 112 to indicate the nozzle 102 for which the DBD test result has been saved. As previously described, indicating a number of the nozzle 102 facilitates the control unit 108 to identify the nozzle 102 for which the DBD test results have been registered in the test result register 110. The DBD module 106 may further update the test complete register 116 to indicate to the control unit 108 that the DBD test has been complete for all the nozzles 102 and the control unit 108 may now process the DBD test result.

In another example, the DBD module 106 may store the DBD test results for each set of nozzles 102 irrespective of whether the nozzle 102 has failed or passed the DBD test. In said example, the DBD module 106 may store the test result for all the sets of nozzles 102 and the control unit 108 may subsequently obtain test results after testing of each set of nozzles 102. Further, in said example, since the control unit 108 is resetting the result-ready register 114 after DBD testing of each set of nozzles 102, option of updating the nozzle count register 112 and the test complete register 116 may be provided to a manufacturer. Said example, may thus facilitate in space optimization as the nozzle count register 112 and the test complete register 116 may not be used.

Figure 2:
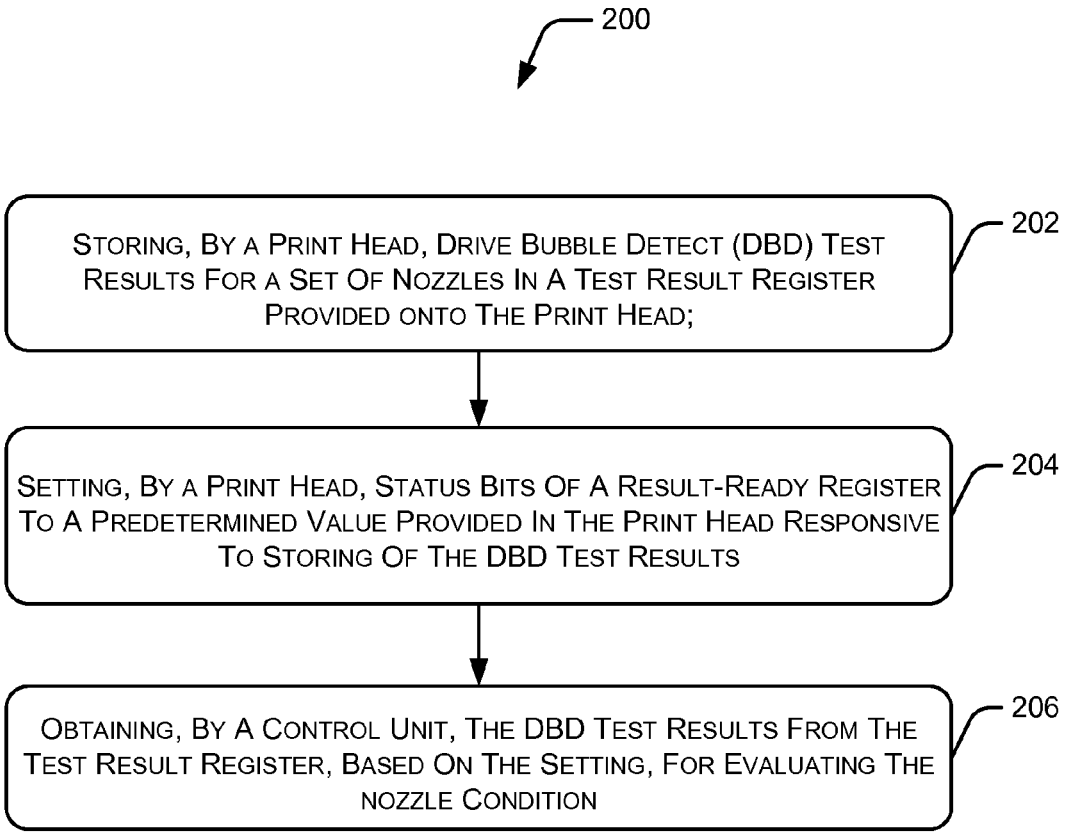
FIG. 2 illustrates a method of evaluating the nozzle condition of a plurality of nozzles, according to an example of the present subject matter.
Figure 3:
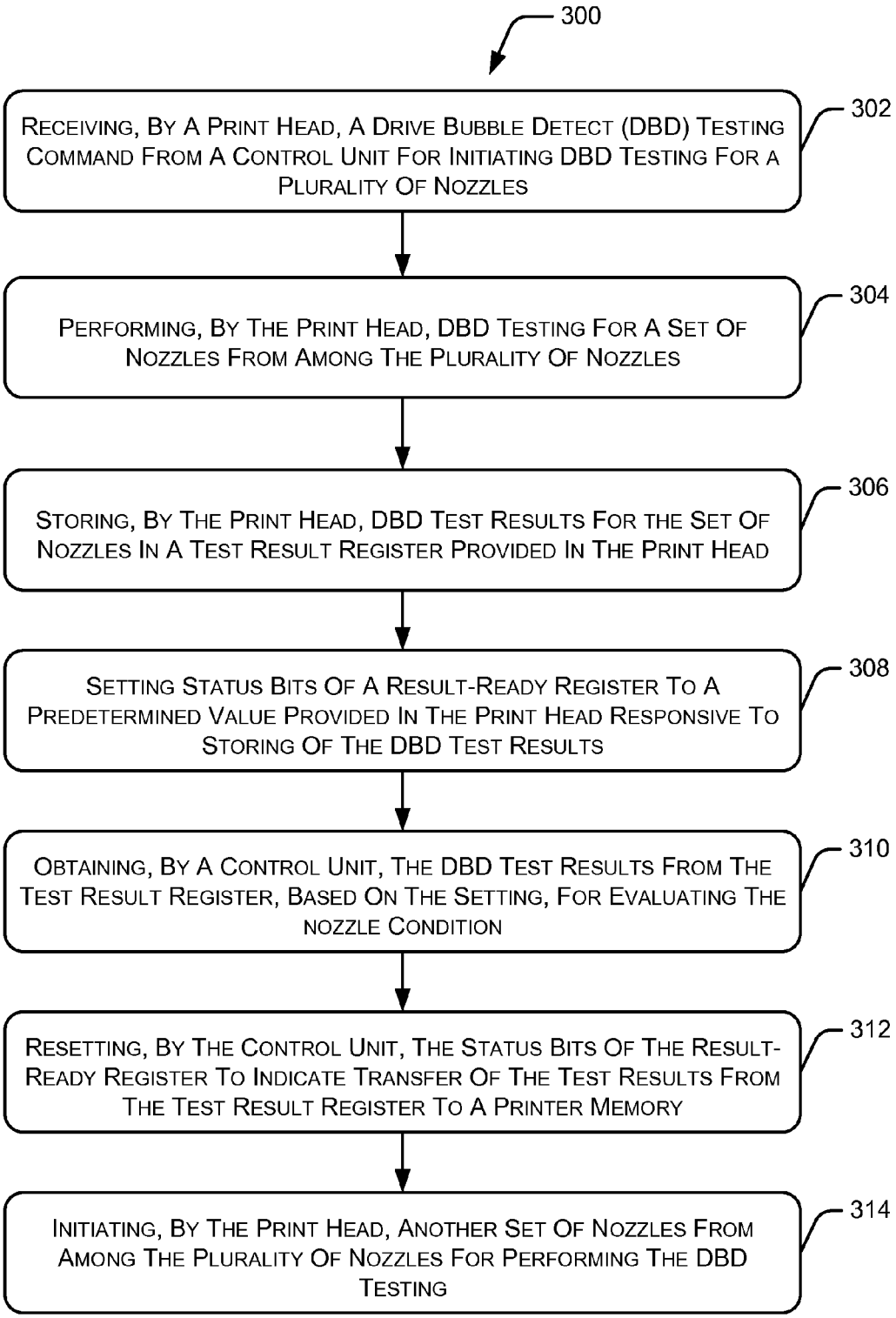
FIG. 3 illustrates a method of evaluating the nozzle condition of a plurality of nozzles, according to another example of the present subject matter.
Figure 4:
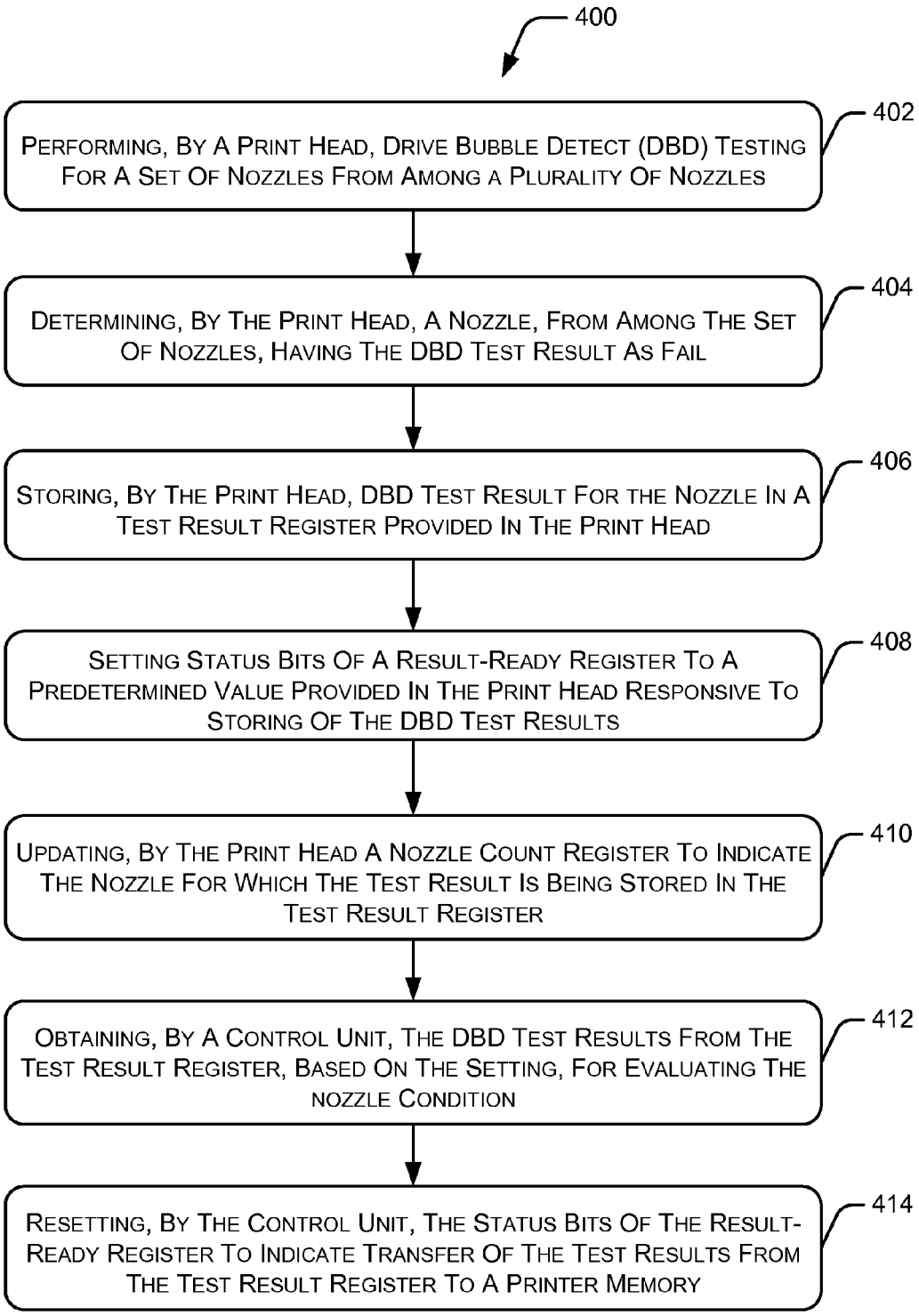
FIG. 4 illustrates a method of evaluating the nozzle condition of a plurality of nozzles, according to yet another example of the present subject matter.

FIGS. 2, 3, and 4 illustrate methods 200, 300, and 400 respectively of evaluating the nozzle condition of a plurality of nozzles, according to an example of the present subject matter. The order in which the methods 200, 300, and 400 are described is not intended to be construed as a limitation, and any number of the described method blocks may be combined in any order to implement the methods 200, 300, and 400, or an alternative method.

Further, although the methods 200, 300, and 400 for evaluating the nozzle condition of a plurality of nozzles may be implemented in a variety of systems; the method methods 200, 300, and 400 are explained in context of the aforementioned system provided in the printer 100.

FIG. 2 illustrates the method 200 of evaluating the nozzle condition of a plurality of nozzles, according to an example of the present subject matter.

At block 202, drive bubble detect (DBD) test results for a set of nozzles from among the plurality of nozzles are stored by a print head. The DBD test results are stored in a test result register provided in the print head. In one example, upon receiving a DBD testing command from a control unit, the print head may perform DBD testing for the set of nozzles and subsequently save the DBD test results. For example, the print head 104 may perform the DBD tests for a set of nozzles 102 and save the DBD test results in the test result register 110 provided in the print head 104.

At block 204, status bits of a result-ready register provided in the print head are set to a predetermined value. The print head may set the status bits of the result-ready register responsive to storage of the DBD test results in the test result register. For instance, the print head may update the status bits to a predetermined value, say, '1' or '0' to indicate storage of the DBD test results in the test result register. In one example, the status bit value '1' may indicate storage of the DBD test result while the status bit value of '0' may indicate an empty test result register and vice versa. For example, upon storing the DBD test results in the test result register 110, the print head 104 may update the status bits of the result-ready register 114 to indicate to the control unit 108 that the DBD test results have been stored.

At block 206, the DBD test results are obtained by the control unit from the test result register. Based on the setting of the status bits of the result-ready register, the control unit may obtain the DBD test results for evaluating the nozzle condition of the nozzles. For example, upon setting up of the status bits of the result-ready register 114 to indicate the registering of the DBD test results in the test result register 110, the control unit 108 obtains the DBD test results for evaluating the nozzle condition of the nozzles print head 104 for which the DBD test results are stored.

FIG. 3 illustrates the method 300 of evaluating the nozzle condition of a plurality of nozzles, according to another example of the present subject matter.

At block 302, a drive bubble detect (DBD) testing command is received by a print head. The print head may receive the DBD testing command from a control unit of a printer for initiating DBD testing for a plurality of nozzles. For example, the print head 104 may receive the DBD testing command from the control unit 108 of the printer 100.

At block 304, DBD testing is performed by the print head. The print head may perform the DBD testing for a set of nozzles from among the plurality of nozzles. For example, upon receiving the DBD testing command from the control unit 108, the print head 104 may perform the DBD tests for a set of nozzles 102.

At block 306, DBD test results for the set of nozzles are stored by the print head. The DBD test results are stored in a test result register provided in the print head. In one example, upon receiving a DBD testing command from a control unit, the print head may perform DBD testing for the set of nozzles and subsequently save the DBD test results. For example, the print head 104 may perform the DBD tests for a set of nozzles 102 and save the DBD test results in the test result register 110 provided in the print head 104.

At block 308, status bits of a result-ready register provided in the print head are set to a predetermined value. The print head may set the status bits of the result-ready register responsive to storage of the DBD test results in the test result register. For instance, the print head may update the status bits to a predetermined value, say, '1' or '0' to indicate storage of the DBD test results in the test result register. In one example, the status bit value '1' may indicate storage of result while the status bit value of '0' may indicate an empty test result register and vice versa. For example, upon storing the DBD test results in the test result register 110, the print head 104 may update the status bits of the result-ready register 114 to indicate to the control unit 108 that the DBD test results have been stored.

At block 310, the DBD test results are obtained by the control unit from the test result register. Based on the setting of the status bits of the result-ready register, the control unit may obtain the DBD test results for evaluating a nozzle condition of the nozzles. For example, upon updating of the status bits of the result-ready register 114 to indicate the registering of the DBD test results in the test result register 110, the control unit 108 obtains the DBD test results for evaluating the nozzle condition of the nozzles 102 for which the DBD test results are stored.

At block 312, the status bits of the result-ready register are reset by the control unit. The control unit may reset the status bits to indicate transfer of the test results from the test result register to a printer memory. Resetting the status bits of the result-ready register facilitates in indicating to the print head that the DBD test results have been successfully obtained by the control unit and the test result register can now be used for storing DBD test results of remaining nozzles. For example, upon obtaining the DBD test results from the test result register 110, the control unit 108 may update the status bits of the result-ready register 114 to indicate the transfer of the DBD test results from the test result register 110 to the printer memory 118.

At block 314, another set of nozzles from among the plurality of nozzles is initiated for performing the DBD testing. For example, upon updating of the status bits of the result-ready register 114 to indicate the transfer of the DBD test results from the test result register 110 to the printer memory 118, the print head 104 initiates DBD testing for another set of nozzles 102.

FIG. 4 illustrates the method 400 of evaluating the nozzle condition of a plurality of nozzles, according to yet another example of the present subject matter.

At block 402, drive bubble detect (DBD) testing is performed by a print head for a set of nozzles from among a plurality of nozzles. The print head may perform the DBD testing upon receiving a DBD testing command from a control unit of a printer. For example, upon receiving the DBD testing command from the control unit 108 of the printer 100, the print head 104 may perform the DBD testing for a set of nozzles 102.

At block 404, a nozzle, from among the set of nozzles, having the DBD test result as fail is determined by the print head. For instance, during DBD testing, if the print head ascertains that impedance associated with a nozzle is lesser or greater than predetermined threshold impedance, the print head may determine the nozzle to have failed the DBD test. For example, the print head 104 may ascertain whether impedance associated with the nozzle 102 is lesser or greater than a predetermined threshold impedance to determine if the nozzle 102 has failed the DBD test.

At block 406, DBD test result for the nozzle is registered by the print head. The DBD test result is registered in a test result register provided in the print head. In one example, upon determining a nozzle to have failed the DBD test, the print head may save the DBD test result for that nozzle in the test result register. For example, upon determining the nozzle 102 to have failed the DBD test, the print head 104 may register the DBD test result for the nozzle 102 in the test result register 110 provided in the print head 104.

At block 408, status bits of a result-ready register provided in the print head are set to a predetermined value. The print head may set the status bits of the result-ready register responsive to registering of the test result register. For instance, the print head may update the status bits to a predetermined value, say, '1' or '0' to indicate storage of the DBD test results in the test result register. In one example, the status bit value '1' may indicate storage of result while the status bit value of '0' may indicate an empty test result register and vice versa. For example, upon registering the DBD test result in the test result register 110, the print head 104 may update the status bits of the result-ready register 114 to indicate to the control unit 108 that the DBD test result has been registered.

At block 410, a nozzle count register provided in the print head is updated. The print head may update the nozzle count register to indicate the nozzle for which the test result is being stored in the test result register. Indicating a number of the nozzle facilitates the control unit to identify the nozzle for which the DBD test result has been registered in the test result register. For example, upon registering the DBD test result in the test result register 110, the print head 104 may update the status bits of the nozzle count register 112 to indicate to the control unit 108 the nozzle 102 for which the test result is being stored in the test result register 110.

At block 412, the DBD test result is obtained by the control unit from the test result register. Based on the setting of the status bits of the result-ready register and the nozzle count register, the control unit may obtain the DBD test results for evaluating a nozzle condition of the nozzles. For example, upon updating of the status bits of the result-ready register 114 to indicate the registering of the DBD test result in the test result register 110, the control unit 108 obtains the DBD test result for evaluating the nozzle condition of the nozzle 102.

At block 414, the status bits of the result-ready register are reset by the control unit. The control unit may reset the status bits to indicate transfer of the test results from the test result register to a printer memory. Resetting the status bits of the result-ready register facilitates in indicating to the print head that the DBD test results have been successfully obtained by the control unit and the test result register can now be used for storing DBD test results of other nozzles that fail the DBD test. For example, upon obtaining the DBD test result from the test result register 110, the control unit 108 may update the status bits of the result-ready register 114 to indicate the transfer of the DBD test result from the test result register 110 to the printer memory 118.

Although examples for the present subject matter have been described in language specific to structural features and/or methods, the present subject matter is not necessarily limited to the specific features or methods described. Rather, the specific features and methods are disclosed and explained in the context of a few examples of the present subject matter.

We claim:

1. A method for evaluating nozzle condition of a plurality of nozzles, the method comprising:

storing, by a print head, drive bubble detect (DBD) test results for a set of nozzles from among the plurality of nozzles in a test result register, wherein the test result register is provided onto the print head;

setting, by the print head, status bits of a result-ready register to a predetermined value provided in the print head responsive to storing of the test result register; and obtaining, by a control unit, the DBD test results from the test result register, based on the setting, for evaluating the nozzle condition.

2. The method as claimed in claim 1, wherein the method further comprises:

resetting, by the control unit, the status bits of the result-ready register to indicate transfer of the DBD test results from the test result register to a printer memory; and initiating, by the print head, another set of nozzles from among the plurality of nozzles for performing DBD tests for evaluating the nozzle condition.

3. The method as claimed in claim 1, wherein the storing further comprises determining, by the print head, a nozzle, from among the set of nozzles, having the DBD test result as fail;

storing the DBD test result for the nozzle in the test result register; and updating a nozzle count register to indicate the nozzle for which the DBD test result is being stored in the test result register.

4. The method as claimed in claim 3, wherein the method further comprises updating a test complete register to indicate completion of DBD testing for the plurality of nozzles.

5. The method as claimed in claim 1, wherein the method further comprises:

receiving, by the print head, a DBD testing command from the control unit for initiating DBD testing for the plurality of nozzles; and performing, by the print head, DBD tests for the set of nozzles.

6. The method as claimed in claim 5, wherein the performing further comprises:

resetting, by the print head, at least the result-ready register and the test result register upon receiving the DBD testing command; and updating, by the print head, status of a fire data register to a predetermined value to initiate DBD test for a corresponding nozzle from among the plurality of nozzles.

7. A print head of a printer, the print head comprising:

a plurality of nozzles;

a test result register for storing drive bubble detect (DBD) test results performed for the plurality of nozzles;

a nozzle count register to indicate nozzles from among the plurality of nozzles for which the DBD test results are being stored in the test result register; and a DBD module communicatively coupled to the plurality of nozzles, wherein the DBD module is to, determine a nozzle, from among the plurality of nozzles, having the DBD test result as fail;

store the DBD test result for the nozzle in the test result register for being used by a control unit of the printer for evaluating nozzle condition of the nozzle based on the DBD test result; and update a nozzle count register to indicate the nozzle for which the DBD test result is being stored in the test result register.

8. The print head as claimed in claim 7 further comprising a result-ready register for indicating status of the test result register, wherein the status is at least one of containing DBD test results and not containing DBD test results.

9. The print head as claimed in claim 8, wherein the DBD module is to further, set status bits of the result-ready register, provided in the print head, to a predetermined value responsive to storing of the DBD test results in the test result register to indicate storing of the DBD test results to the control unit of the printer for evaluating the nozzle condition of the nozzle based on the DBD test results.

10. The print head as claimed in claim 7 further comprising a test complete register to indicate completion of DBD testing for the plurality of nozzles.

11. The print head as claimed in claim 7, wherein the DBD module is to further, receive a DBD testing command from the control unit for initiating the DBD testing for the plurality of nozzles;

reset at least the nozzle count register, a result-ready register, a test complete register, and the test result register upon receiving the DBD testing command; and update status of a fire data register to a predetermined value to initiate DBD test for the corresponding nozzle from among the plurality of nozzles.

12. A printer comprising:

a print head comprising a plurality of nozzles; and a drive bubble detect (DBD) module communicatively coupled to the plurality of nozzles, wherein the DBD module is to, store DBD test results performed for a set of nozzles from among the plurality of nozzles in a test result register provided in the print head; and set status bits of a result-ready register, provided in the print head, to a predetermined value responsive to storage of the DBD test results in the test result register; and a control unit communicatively coupled to the print head to obtain the DBD test results from the test result register, based on the status bits, for evaluating nozzle condition of the set of nozzles.

13. The printer as claimed in claim 12, wherein the print head further comprising, the test result register for storing the DBD test results; and the result-ready register for indicating status of the test result register, wherein the status is at least one of containing DBD test results and not containing DBD test results.

14. The printer as claimed in claim 12, wherein the control unit resets the status bits of the result-ready register to indicate transfer of the DBD test results from the test result register to a printer memory; and the DBD module initiates another set of nozzles from among the plurality of nozzles for performing DBD tests for evaluating the nozzle condition.

15. The printer as claimed in claim 12, wherein the DBD module is to further, determine a nozzle, from among the set of nozzles, having the DBD test result as fail;

store the DBD test result for the nozzle in the test result register; and update a nozzle count register to indicate the nozzle for which the DBD test result is being stored in the test result register.

* * * * *